United States Patent [19]

Gulla et al.

[11] 3,977,884

[45] Aug. 31, 1976

[54] METAL PLATING SOLUTION

[75] Inventors: Michael Gulla, Sherborn; Charles A. Gaputis, Hyde Park, both of Mass.

[73] Assignee: Shipley Company, Inc., Newton, Mass.

[22] Filed: Jan. 2, 1975

[21] Appl. No.: 538,125

[52] U.S. Cl. ..... 106/1; 427/304; 427/305

[51] Int. Cl.[2] ..... C23C 3/02

[58] Field of Search ..... 106/1; 117/130 E, 130 B; 427/305, 304

[56] References Cited

UNITED STATES PATENTS

| | | | |
|---|---|---|---|
| 2,762,723 | 9/1956 | Talmey et al. | 117/130 E |
| 3,738,849 | 6/1973 | Bellis | 106/1 |
| 3,764,352 | 10/1973 | Gulla | 106/1 |

*Primary Examiner*—Lorenzo B. Hayes
*Attorney, Agent, or Firm*—Robert L. Goldberg

[57] ABSTRACT

An electroless metal plating solution is characterized by an elemental sulfur stabilizer, either in colloidal or soluble, non-ionic form. Elemental sulfur as a stabilizer is an improvement over prior art stabilizers as it can be used in substantially larger concentration than prior art divalent sulfur stabilizers which are catalytic poisons.

21 Claims, No Drawings

METAL PLATING SOLUTION

BACKGROUND OF THE INVENTION

1. Field of Invention

This invention relates to metal plating solutions, and more particularly, to electroless metal plating solutions stabilized with elemental sulfur.

2. Description of the Prior Art

Electroless metal doposition refers to the chemical plating of a metal over an activated surface by chemical or auto-catalytic reduction of metal ions in the absence of an external electric current. Compositions and processes useful for this deposition are in wide commercial use and are described in numerous publications. Examples of electroless deposition plating solutions are described in U.S. Pat. Nos. 2,938,305; 3,011,920; 3,313,224 and 3,361,580, all incorporated herein by reference.

Known electroless metal depositions solutions generally comprise at least four ingredients dissolved in water. They are (1) a source of metal ions, e.g., water soluble salts of a plating metal such as cupric sulfate or nickel chloride, (2) a reducing agent such as formaldehyde for copper plating solutions, a hypophosphite or amine-borane for nickel plating solutions and hydrazine for plating solutions such as palladium, (3) an acid or hydroxide pH adjuster to provide required solution acidity or basicity and (4) a complexing agent for the metal ions sufficient to prevent their precipitation from solution. A large number of suitable complexing agents for electroless metal solutions are described in the above noted patents and also in U.S. Pat. Nos. 2,874,072; 3,075,856 and 3,075,855, also incorporated herein by reference.

It is known in the art that electroless metal plating solutions tend to be unstable and spontaneously decompose, possibly due to the presence of catalytic nuclei in a solution containing both a reducing agent and reducible metal ions.

It is known that this decomposition can be retarded and the life of the plating solution increased by the addition of various solution soluble additives in small concentrations which additives are known in the art as stabilizers. Illustrative examples of said stabilizers are given in U.S. Pat. Nos. 3,310,320; 3,361,580 and 3,436,233 (soluble divalent sulfur compounds); 3,403,035 and 3,310,430 (soluble cyano compounds); and 3,661,597 and 3,457,089 (soluble acetylentic compounds).

In general, these stabilizers are catalytic poisons when used in excess of trace amounts. Therefore, they are typically used in concentrations of a few parts per million parts of solution. Larger amounts can retard the rate of deposition, may even prevent deposition, and frequently adversely effect the ductility and color of the deposit. Such adverse effects have been described in U.S. Pat. No. 3,804,638 and by A. Molenaar et al., *Plating* 649, (1974). Preferred stabilizers are those which stabilize, but are not catalytic poisons and consequently, do not require strict concentration control nor adversely affect the rate and quality of deposition. For example, mercury compounds, capable of dissociating to yield mercury ions in small concentrations, as described in U.S. Pat. No. 3,663,242, improve bath stability without decreasing the rate of deposition.

STATEMENT OF THE INVENTION

The present invention is based upon the discovery that elemental sulfur can be used as a stabilizer for electroless baths and that such materials, as stabilizers, are not catalytic poisons within relatively large concentration ranges and hence, do not seriously retard plating rate. Moreover, elemental sulfur is at least as effective a stabilizer as the prior art divalent sulfur stabilizers and, in many cases, is more effective. Accordingly, the present invention provides an electroless metal deposition solution comprising (1) a source of metal ions, (2) a reducing agent therefor, (3) a pH adjuster, (4) a complexing agent for the metal ions sufficient to prevent their precipitation from solution and (5) an elemental sulfur stabilizer for the solution, alone as a primary stabilizer, or in combination with a prior art secondary stabilizer.

DESCRIPTION OF THE PREFERRED EMBODIMENTS

For purposes of definition, the term "elemental sulfur" as used herein means non-ionic sulfur, preferably in colloidal form dispersed throughout the plating solution, but also, if desired, dissolved in the plating bath or in an emulsion wherein the elemental sulfur is dissolved in a solvent insoluble in the plating bath which solvent is dispersed through the plating bath as an emulsion.

An electroless metal plating solution stabilized with elemental sulfur in accordance with this invention is used to deposit metal in the same manner as prior art electroless metal solutions. The surface of the part to be plated should be free of grease and contaminating material. Where a non-metallic surface is to be plated, the surface area to receive the deposit must first be sensitized to render it catalytic to the reception of the electroless metal as by the well-known treatment with the catalysts of U.S. Pat. No. 3,011,920, particularly that resulting from the admixture of palladium chloride and stannous chloride where the stannous chloride is in molar excess of the amount of palladium, the catalyst being in hydrochloric acid solution.

In accordance with the invention, elemental sulfur is preferably added to the plating bath in an addition agent. The addition agent may be in the form of colloidal sulfur or a solution of elemental sulfur which may form a colloid when added to an electroless bath as will be described in greater detail below.

As noted above, elemental sulfur in colloidal form is preferred. A preferred method of making colloids of elemental sulfur comprises admixing hydrogen sulfide gas with sulfur dioxide to produce an aqueous colloid. Another method involves the formation of an organic solvent solution of sulfur. Although the solvent used to effect this solution can be taken from a class of organic solvents soluble in water and able to dissolve at least a trace amount of sulfur, best results are obtained by an appropriate choice of a solvent of low vapor pressure at bath temperature to ensure minimum solvent loss due to vaporization with resulting sedimentation of sulfur. Useful solvents include water miscible organic liquids such as methanol, ethanol, propanol, isopropanol, cellusolve, ethylene glycol, propylene glycol, butyl alcohol, butyrolacetone, hexyleneglycol, M-pyrol, methyl ethylketone, ethylacetoacetate, methyl-acetoacetate, $\alpha$-hydroxyethylacetoacetate, $\alpha$hydroxycyclopentanone, 1,2-dihydroxy cyclohexane, Dowanol PM and Dowanol DE.

The sulfur solution (the addition agent) is added to the bath to produce the colloid in situ in the bath, or more preferbly, is mixed with water forming the colloid prior to addition to the plating bath. The ratio of organic solvent solution to water or plating bath is dependent upon the final concentration of sulfur dissolved in the plating bath. This aqueous solution may be acidic, neutral or basic prior to formation of the colloidal sulfur though the addition of sodium hydroxide to form a basic solution is believed to result in some dissolution of colloidal sulfur. In this respect, it is believed that in most cases, sulfur is in the form of the colloid in the plating solution. However, in some plating solutions, the sulfur is solvated. In those instances, the soluble form of the sulfur is still within the scope of the invention as it is still in elemental form. In other cases, where a solution insoluble organic solvent is used, an emulsion of the organic solvent in the plating solution will form which is also within the scope of the invention.

For long periods of use, an emulsifying agent should be used when sulfur is added as an emulsion, or a protective colloid should be used, such as hydroxyethylcellulose, when the sulfur is added in the form of a colloid.

The concentration of the elemental sulfur stabilizer in the plating solutions is not critical. Generally, the addition of one or less parts per million (as sulfur) improves stability. A preferred minimum concentration is 0.2 parts per million parts of solution and more preferably, 2.5 parts per million. A maximum concentration is difficult to define because it is dependent upon the amount of sulfur that can be dissolved in a suitable solvent. As is known in the art, elemental sulfur is more soluble in hot solutions than in cold or room temperature solutions. In general, the maximum concentration in the making of the addition agent as described above can exceed the maximum concentration used for ionic stabilizers which are catalytic poisons since the elemental sulfur stabilizers do not poison the bath. In some cases, dependent upon the plating solution, large concentrations, in excess of 50 parts per million, restrict the rate of deposition, but such concentrations are far in excess of that possible with divalent sulfur stabilizer which could prevent deposition in these large concentrations. For such plating solutions, this is a practical maximum concentration. For others, the maximum concentration is only limited by practicality. For purposes of definition, the amount of stabilizer added is that amount that results in a bath having its useful life increased by at leas 50% over its useful life when free of stabilizer.

The invention will be better understood by reference to the following examples where the stability of solution was measured by the time (minutes) it takes a bath to spontaneously decompose (trigger) when plating catalyzed cloth at one-half square foot per gallon or when plating activated aluminum. Rate for both electroless nickel and electroless copper was determined by plating catalyzed (G-10 epoxy) board.

Catalyzed cloth was prepared by treating a cotton fabric according to the following sequence of steps:

1. Rinse cloth in a 20% (by weight) ammonium hydroxide solution maintained at room temperature for five minutes.
2. Rinse for five minutes in 20% acetic acid solution maintained at room temperature. Rinse in cold water.
3. Immerse for from 20 to 40 seconds in a sensitizing composition of a palladium containing colloid having a protective stannic acid colloid maintained at room temperature. Rinse in cold water.
4. Immerse for 1 to 3 minutes in a dilute hydrochloric acid solution maintained at room temperature. Rinse in cold water.
5. Dry cloth and cut to size.

Activated aluminum is formed by immersing a sample of aluminum in hydrochloric acid until a heavy, frangible layer of smut forms over the aluminum.

Catalyzed board was prepared from type G-10 epoxy sheet as follows:

1. Cut epoxy to a size measuring 2 inches × 2 inches.
2. Scrub clean with an abrasive cleaner. Rinse in cold water.
3. Treat for from 1 to 3 minutes with a non-ionic surfactant conditioner maintained at room temperature. Rinse in cold water.
4. Immerse for from 1 to 3 minutes in a sensitizing solution of a palladium containing colloid having a protective stannic acid colloid maintained at room temperature. Rinse in cold water.
5. Immerse for 1 to 3 minutes in a dilute hydrochloric acid solution maintained at room temperature. Rinse in cold water.

In all examples, wherever concentration of sulfur is expressed, it is in parts per million as sulfur.

EXAMPLES 1 – 10

These examples compare stability, take-off, rate and coverage of electroless copper baths containing various sulfur stabilizers. The base bath formulation was as follows:

| | | | |
|---|---|---|---|
| copper sulfate pentahydrate | 10 gm/liter | sodium hydroxide | 10 gm/liter |
| tartaric acid | 20 gm/liter | water | to 1 liter |
| formaldehyde | 10 gm/liter | temperature | 72°F |

The results obtained are as follows:

| Example Number | Stabilizer[1][2] (Conc.-ppm) | Stability (min.) | Plating Rate (per 10 min.) | Take-Off | Coverage |
|---|---|---|---|---|---|
| 1 | — | 20 | $24 \times 10^{-6}$ | good | partial |
| 2 | NaSH (5) | >120 | $17 \times 10^{-6}$ | fair | complete |
| 3 | thiourea(1) | >120 | $22 \times 10^{-6}$ | fair | complete |
| 4 | thiourea(5) | >120 | $12 \times 10^{-6}$ | poor | partial |
| 5 | thiourea(10) | >120 | 0 | none | none |
| 6 | thiomalic(1) | 85 | $28 \times 10^{-6}$ | fair | complete |
| 7 | thiomalic(5) | >120 | $15 \times 10^{-6}$ | fair | complete |
| 8 | thiomalic(15) | >120 | 0 | none | none |
| 9 | colloidal(1) | >120 | $28 \times 10^{-6}$ | good | complete |

-continued

| Example Number | Stabilizer[1][2] (Conc.-ppm) | Stability (min.) | Plating Rate (per 10 min.) | Take-Off | Coverage |
|---|---|---|---|---|---|
| 10 | colloidal(10) | >120 | $17 \times 10^{-6}$ | good | complete |

[1]Thiourea, thiomalic acid and sodium bisulfide are examples of divalent sulfur for purposes of comparison.
[2]Colloid made by dissolving sulfur in propanol and mixing with aqueous 0.4 N sodium hydroxide solution.

EXAMPLES II – 14

Colloidal sulfur (made by dissolving sulfur in methanol and mixing with aqueous 0.4 N sodium hydroxide solution) was tested using the electroless copper plating solution of Example 1 and substituting several chelating agents for tartaric acid as follows:

| Example Number | Chelating Agent | Stabilizer (ppm) | Stability (min.) | Plating Rate(per 10 min.) | Take-Off | Coverage |
|---|---|---|---|---|---|---|
| 11 | pentahydroxy propyl diethylene triamine | — | 60 | $40 \times 10^{-6}$ | good | complete |
| 12 | " | (2) | >120 | $38 \times 10^{-6}$ | good | complete |
| 13 | ethylene diamine tetracetic acid | — | >120 | $10 \times 10^{-6}$ | fair | complete |
| 14 | " | (2) | >120 | $9 \times 10^{-6}$ | fair | complete |

EXAMPLES 15 – 22

These examples used the following base formulation:

| | |
|---|---|
| copper sulfate pentahydrate | 12 grams/liter |
| tartaric acid | 20 grams/liter |
| formaldehyde | 12 grams/liter |
| sodium hydroxide | 12 grams/liter |
| water | to 1 liter |

To the base formulation, there was added varying amounts of colloidal sulfur formed by saturating methanol with sulfur and mixing with water. Stability and plating rate were determined with the following results:

| Example No. | Stabilizer | Stability (min.) | Plating Rate (per 10 min.) |
|---|---|---|---|
| 15 | — | 9 | $13 \times 10^{-6}$ |
| 16 | ½ | 12 | $13 \times 10^{-6}$ |
| 17 | 1½ | 95 | $13 \times 10^{-6}$ |
| 18 | 2½ | >120 | $13 \times 10^{-6}$ |
| 19 | 10 | >120 | $17 \times 10^{-6}$ |
| 20 | 15 | >120 | $17 \times 10^{-6}$ |
| 21 | 25[1] | >120 | $17 \times 10^{-6}$ |
| 22 | 50[1] | >120 | $15 \times 10^{-6}$ |

[1]Both turned green and a scum formed on the surface. However the bath plated normally.

EXAMPLES 23 – 43

Using the bath formulation of Example 1, colloidal sulfur in various organic media was formulated to establish that the stability is due to the sulfur, not the solvent.

| Example No. | Solvent | Stabilizer (ppm) | Stability (min) |
|---|---|---|---|
| 23 | — | — | 23 |
| 24 | methanol | 0 | 30 |
| 25 | methanol | 2½ | >120 |
| 26 | ethanol | 0 | 30 |
| 27 | ethanol | 2 | >120 |
| 28 | propanol | 0 | 25 |
| 29 | propanol | 2½ | >120 |
| 30 | acetone | 0 | 67 |
| 31 | acetone | 2 | >120 |
| 32 | methyl ethyl ketone | 0 | 82 |
| 33 | methyl ethyl ketone | 2 | >120 |
| 34 | Dowanol DE | 0 | 43 |
| 35 | Dowanol DE | 2 | >120 |
| 36 | Dowanol PM | 0 | 57 |
| 37 | Dowanol PM | 2½ | >120 |
| 38 | ethylene glycol | 0 | 34 |
| 39 | ethylene glycol | 2½ | >120 |
| 40 | propylene glycol | 0 | 26 |
| 41 | propylene glycol | 3 | >120 |
| 42 | ethyl acetoacetate | 0 | 66 |
| 43 | ethyl acetoacetate | 2 | >120 |

EXAMPLES 44 – 46

Sulfur was added to the following base formulation:

| | |
|---|---|
| Nickel sulfate | 20 grams/liter |
| Hypophosphite | 30 grams/liter |

-continued

| | |
|---|---|
| Hydroxy acetic acid | 33 ml/liter |
| Water | to 1 liter |
| Temp. | 190°F |

| Example No. | Stabilizer (ppm) | Stability (min.) | Rate (per 10 min.) |
|---|---|---|---|
| 44 | — | 18 | $55 \times 10^{-6}$ |
| 45 | thiourea (4.4) | >60 | $83 \times 10^{-6}$ |
| 46 | colloidal sulfur (4.4) | >60 | $83 \times 10^{-6}$ |

EXAMPLES 47 – 49

Bath 2 of U.S. Pat. No. 3,338,726 (electroless nickel using dimethyl amine borane as a reducing agent) was prepared and stabilized in accordance with this invention with results as follows:

| Example No. | Stabilizer (ppm) | Stability (min.) | Rate (per 10 min.) |
|---|---|---|---|
| 47 | — | 30 | $25 \times 10^{-6}$ |
| 48 | thiourea (4.4) | >60 | $35 \times 10^{-6}$ |
| 49 | colloidal sulfur (4.4) | >60 | $35 \times 10^{-6}$ |

Elemental sulfur can be added in concentrations of from ½ppm to 25 or more ppm to the following formulation with improved stability in accordance with this invention.

EXAMPLE 50

| | |
|---|---|
| Potassium gold cyanide | 28 grams/liter |
| citric acid | 60 grams/liter |
| tungstic acid | 45 grams/liter |
| sodium hydroxide | 16 grams/liter |
| N,N-diethyl glycine (sodium salt) | 4 grams/liter |
| Phthalic acid (mono-potassium salt) | 25 grams/liter |
| Water | to 1 liter |

EXAMPLE 51

| | |
|---|---|
| cobalt chloride hexahydrate | 30 grams/liter |
| sodium citrate dihydrate | 80 grams/liter |
| ammonium chloride | 50 grams/liter |
| sodium hypophosphite monohydrate | 20 grams/liter |
| ammonium hydroxide | 60 ml/liter |
| water | to 1 liter |

EXAMPLE 52

| | |
|---|---|
| cobalt sulfate heptahydrate | 50 grams/liter |
| sodium hypophosphite decahydrate | 70 grams/liter |
| ammonium hydroxide | 7.5 ml/liter |
| dimethylamine borane | 1.5 gram/liter |
| water | to 1 liter |

EXAMPLE 53

| | |
|---|---|
| palladium chloride | 2 grams/liter |
| hydrochloric acid (38%) | 4 ml/liter |
| ammonium hydroxide (28%) | 160 ml/liter |

-continued

| | |
|---|---|
| sodium hypophosphite monohydrate | 10 grams/liter |
| water | to 1 liter |

EXAMPLE 54

Same as Example 44 with addition of 1 gram per liter of cupric chloride.

We claim:

1. In an electroless plating bath containing a source of metal ions selected from the group consisting of copper, nickel, cobalt, gold and palladium, a complexing agent to maintain said ions in solution and a reducing agent for said metal ions, the improvement comprising elemental sulphur in said plating bath in an amount of at least 0.2 parts per million parts of the bath.

2. The bath of claim 1 where the amount is at least 2.5 parts per million.

3. The bath of claim 1 where the amount ranges between 2.5 and 50 parts per million.

4. The bath of claim 1 where the elemental sulfur is in the form of a colloid in the bath.

5. The metal plating bath of claim 3 where the elemental sulfur is dissolved in the bath.

6. The bath of claim 1 where the elemental sulfur is in the form of an emulsion in the bath, said emulsion comprising sulfur dissolved in a solvent dispersed in said bath.

7. In an electroless copper plating bath comprising a source of cupric ions, a reducing agent therefor and a complexing agent to maintain said cupric ions in solution, the improvement comprising elemental sulphur in said plating bath in an amount of at least 0.2 parts per million parts of the bath.

8. The bath of claim 7 where the reducing agent is formaldehyde.

9. The bath of claim 8 where the complexing agent is a carboxylic acid.

10. The bath of claim 8 where the amount of elemental sulfur ranges between 2.5 and 50 parts per million parts of the bath.

11. The bath of claim 8 where the elemental sulfur is in the form of a colloid in the bath.

12. The bath of claim 8 where the elemental sulfur is dissolved in the bath.

13. The bath of claim 8 where the elemental sulfur is in the form of an emulsion in the bath, said emulsion comprising sulfur dissolved in a solvent dispersed in said bath.

14. In an electroless nickel plating bath comprising a source of nickel ions, a complexing agent to maintain said nickel ions in solution and a reducing agent for said nickel ions, the improvement comprising elemental sulphur in said plating bath in an amount of at least 0.2 parts per million parts of the bath.

15. The plating bath of claim 14 where the reducing agent is a hypophosphite.

16. The plating bath of claim 14 where the reducing agent is a borane.

17. The plating bath of claim 14 where the amount ranges between 2.5 and 50 parts per million.

18. The plating bath of claim 14 where the elemental sulfur is in the form of a colloid in the bath.

19. The plating bath of claim 14 where the elemental sulfur is dissolved in the bath.

20. The plating bath of claim 14 where the elemental sulfur is in the form of an emulsion in the bath, said emulsion comprising sulfur dissolved in a solvent dispersed in said bath.

21. A method of replenishing an electroless metal plating bath comprising a source of metal ions selected from the group consisting of copper, nickel, cobalt, gold and palladium, a reducing agent therefor and a complexing agent to maintain said metal ions in solution, said method comprising the addition of an agent to said bath, said agent comprising a member selected from the group of colloids, emulsions and solutions of elemental sulphur in an amount of at least 0.2 parts per million parts of the bath.

* * * * *